US005183261A

United States Patent [19]

Nobi

[11] Patent Number: 5,183,261

[45] Date of Patent: Feb. 2, 1993

[54] BUMPER BOWLING GAME WITH GRAVITY RELEASED BALL PROJECTOR

[76] Inventor: Josef Nobi, 7808 Lela La., Loveland, Colo. 80538

[21] Appl. No.: 808,096

[22] Filed: Dec. 16, 1991

[51] Int. Cl.[5] ..... A63D 3/02

[52] U.S. Cl. ..... 273/38; 273/39; 273/120 R; 273/129 Q

[58] Field of Search ..... 273/37, 38, 39, 85 R, 273/108, 118 R, 119 R, 120 R, 120 A, 126 R, 126 A, 129 R, 129 Q

[56] References Cited

U.S. PATENT DOCUMENTS

| | | | |
|---|---|---|---|
| 652,056 | 6/1900 | Tait | 273/120 R |
| 1,051,613 | 1/1913 | Miller et al. | 273/39 |
| 2,490,288 | 12/1949 | Wickersham | 273/120 R |
| 3,039,772 | 6/1962 | Simjian | 273/39 |
| 3,174,752 | 3/1965 | Plentis | 273/126 R |
| 3,219,349 | 11/1965 | Smith | 273/126 R |
| 3,792,862 | 2/1974 | Livick | 273/38 |
| 3,817,529 | 6/1974 | Dobbins | 273/126 R |
| 3,866,917 | 2/1975 | Ensmann et al. | 273/120 R |

*Primary Examiner*—V. Millin
*Assistant Examiner*—William M. Pierce
*Attorney, Agent, or Firm*—William E. Hein

[57] ABSTRACT

A bumper bowling game, combining the features and required skills of conventional billiards and bowling, includes a V-shaped table having flat outgoing and return alleyways with a concave gutter along each side thereof. The outgoing and return alleyways are joined at their distal ends by a cushioned bumper. A ball starter at the proximal end of the outgoing alleyway may be aimed by moving it laterally and pivotally and includes a starting ramp down which a ball rolls by gravity to gain sufficient speed to propel it in an outbound direction along the outgoing alleyway. When the ball comes in contact with the cushioned bumper, it is deflected and caused to travel in the opposite or return direction along the return alleyway. A number of pins, shaped like conventional bowling pins, are arranged in the same configuration as in conventional bowling at the proximal end of the return alleyway to be knocked down by the ball as it travels along the return alleyway. Scoring is the same as in conventional bowling.

1 Claim, 2 Drawing Sheets

BUMPER BOWLING GAME WITH GRAVITY RELEASED BALL PROJECTOR

BACKGROUND AND SUMMARY OF THE INVENTION

This invention relates generally to table games and more specifically to a table game that combines the features of the conventional games of billiards and bowling. In billiards, the user employs a cue stick to strike a cue ball that is, in turn, intended to strike another ball to impel it into one of several pockets positioned along the periphery of the billiard table. In order to strike another ball, the cue ball is oftentimes intentionally deflected off a bumper or cushion along the periphery of the billiard table. In bowling, the user must travel to a specially constructed bowling alley to play the game, which involves rolling a bowling ball down a long, straight alley in an attempt to knock over as many of the pins arranged at the far end of the alley as possible.

It is therefore the principal object of the present invention to provide a bumper bowling game that combines the features and required skills of both conventional billiards and bowling in a table top game that can easily be accommodated in the user's home.

This and other objects are accomplished in accordance with the illustrated preferred embodiment of the present invention by providing a V-shaped table having flat outgoing and return alleyways with a concave gutter along each side thereof. The outgoing and return alleyways are joined at their distal ends by a cushioned bumper. A ball starter at the proximal end of the outgoing alleyway may be aimed by moving it laterally and pivotally and includes a starting ramp down which a ball rolls by gravity to gain sufficient speed to propel it in an outbound direction along the outgoing alleyway. When the ball comes in contact with the cushioned bumper, it is deflected by the bumper and caused to travel in the opposite or return direction along the return alleyway. A number of pins, shaped like conventional bowling pins, are arranged in the same configuration as in conventional bowling at the proximal end of the return alleyway to be knocked down by the ball as it travels along the return alleyway. Scoring is the same as in conventional bowling.

DETAILED DESCRIPTION OF THE PREFERRED EMBODIMENT

Figure 1:
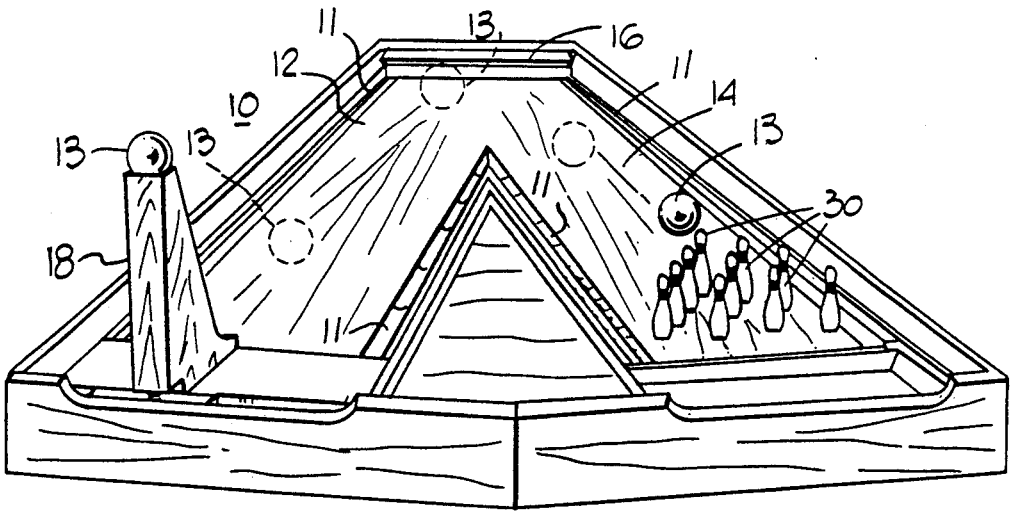
FIG. 1 is a pictorial diagram illustrating the V-shaped table, ball starter, and bowling pins that comprise the bumper bowling game of the present invention.
Figure 2:
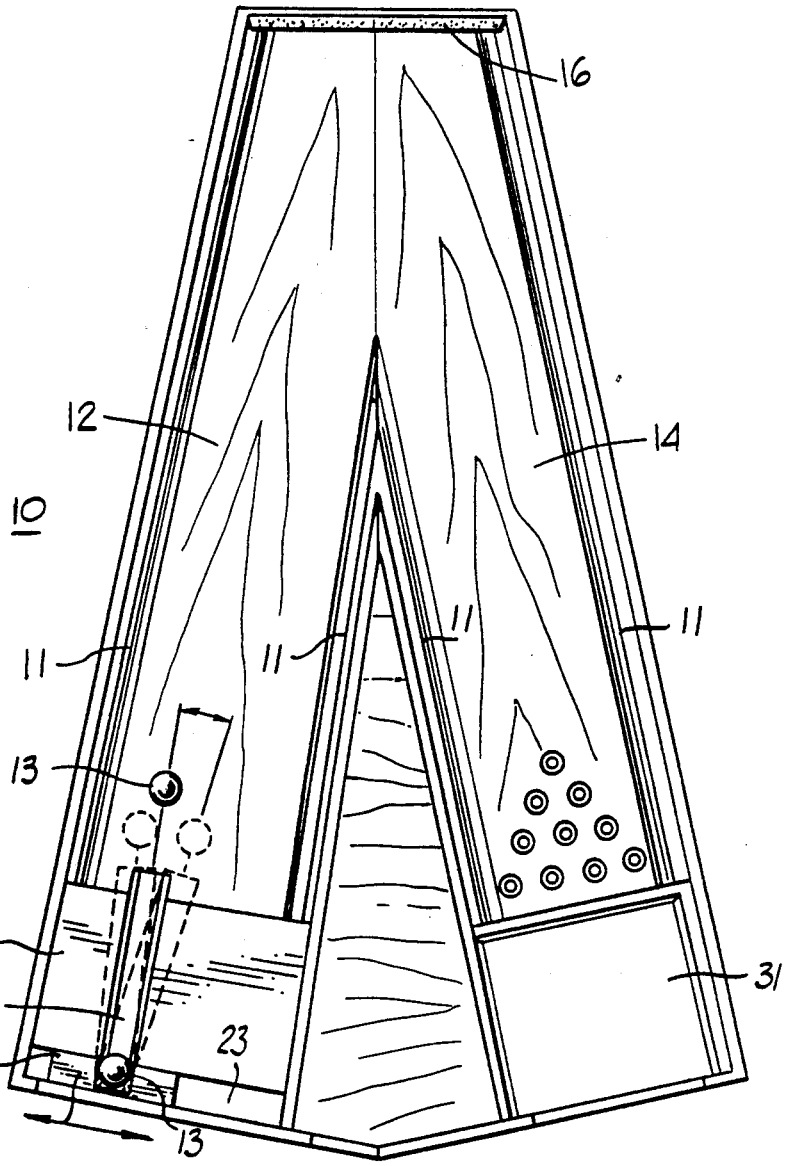
FIG. 2 is a top view of the V-shaped table and other components of the bumper bowling game of FIG. 1.
Figure 3:
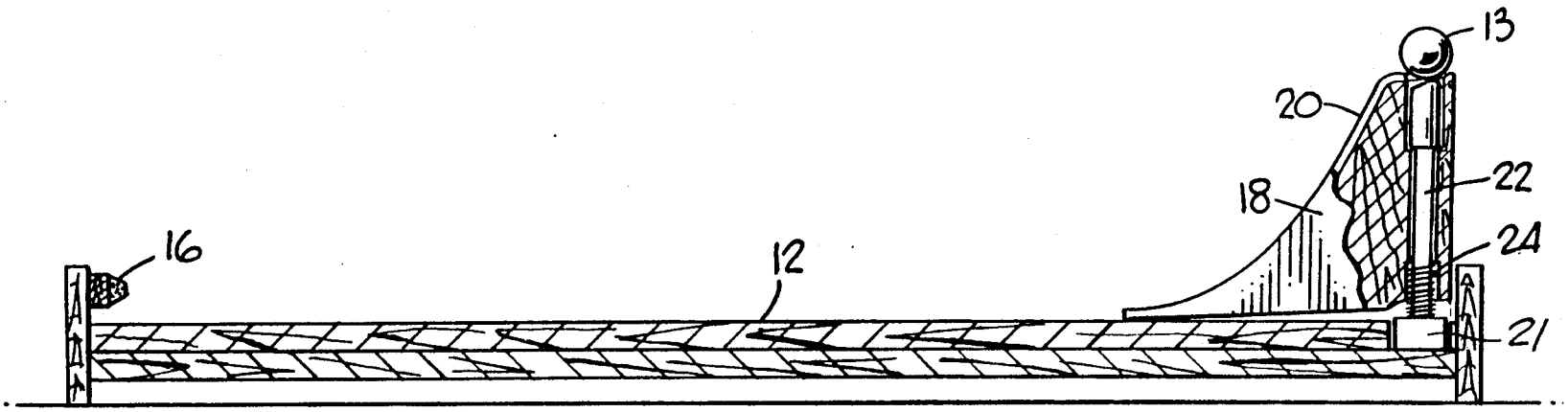
FIG. 3 is a cross-sectional diagram of an outgoing alleyway of the V-shaped table of FIGS. 1 and 2 that includes the ball starter.
Figure 4:
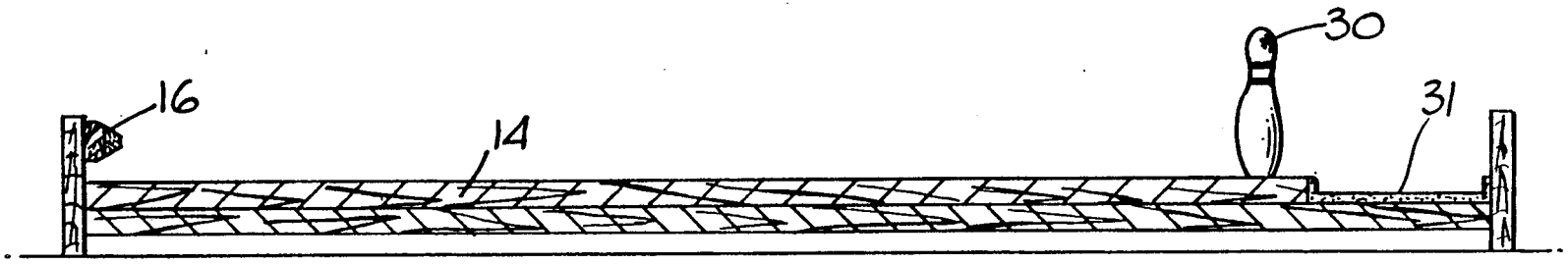
FIG. 4 is a cross-sectional diagram of a return alleyway of the V-shaped table of FIGS. 1 and 2.

Referring now to FIGS. 1–4, there is shown a horizontally-positioned V-shaped table 10 that includes a left outgoing alleyway 12 and a right return alleyway 14. The table 10 may be constructed of a number of commercially available materials, such as hardwoods, for example. Each of the outgoing and return alleyways 12 and 14 provides a flat surface along which a ball 13 is permitted to roll. Gutters 11 are provided on each side of the outgoing and return alleyways 12 and 14. Gutters 11 are concave in shape and have a radium slightly larger than that of ball 13 to permit ball 13 to easily roll within gutter 11 if inadvertently directed there by an unskilled user. The outgoing and return alleyways 12 and 14 are joined at the distal ends thereof by a linear cushioned bumper 16. A ball starter 18 is positioned at the proximal end of outgoing alleyway 12 on a starting platform 19 that is contiguous to and level with outgoing alleyway 12. Ball starter 18 is arranged to retain ball 13 in a starting position atop ball starter 18 and is further arranged for lateral and pivotal aiming motion, as illustrated in FIG. 2. In addition, ball starter 18 includes a downward sloping starting ramp 20, illustrated in FIG. 3, down which ball 13 travels by the force of gravity when released from its initial or starting position atop ball starter 18. Lateral motion of ball starter 18 is provided by permitting sideways movement of a base member 21 of ball starter 18 within a groove 23 at the proximal end of the starter platform 19. Pivotal motion of ball starter 18 is about a vertical dowel 22 positioned within ball starter 18 at the proximal end thereof. A bottom end of dowel 22 is fixedly attached to base member 21. A spring 24 maintains the rear portion of ball starter 18 in a slightly raised position above starting platform 19. When the rear portion of ball starter 18 is pushed downward by the user against the force of spring 24, dowel 22 pushes ball 13 off the top of ball starter 18 and permits it to roll down ramp 20 to gain sufficient speed to propel it in an outbound direction, determined by aiming ball starter 18, along outgoing alleyway 12. When ball 13 comes in contact with bumper 16, it is deflected thereby to travel in a return direction along return alleyway 14. A number of bowling pins 30 are arranged at the proximal end of return alleyway 14 to be knocked down by ball 13 as it travels in the return direction along return alleyway 14. Bowling pins 30 are are of the same shape as conventional bowling pins and are also arranged in the same configuration as in conventional bowling. A pin storage compartment 31, slightly recessed below the surface of return alleyway 14, is provided at the proximal end of return alleyway 14.

It has been found convenient to construct the bumper bowling game of the present invention to a scale that is ¼ the size of the components found in a conventional bowling alley. For example, pins 30 are ¼ the size of conventional bowling pins, while the combined length of outgoing and return alleyways 12 and 14 is ¼ the length of a conventional bowling alley. Ball 13 is also ¼ the size of a conventional bowling ball, which results in its being the same size as a conventional billiard ball. Scoring in the bumper bowling game of the present invention is the same as in conventional bowling.

In use, the V-shaped table 10 of the instant bumper bowling game, is solidly positioned at approximately waist level. The user stands adjacent the proximal end of the outgoing runway 12 in order to aim ball starter 18 and to release ball 13 therefrom. At this position, the user may easily rearrange pins 30 as they are knocked over by ball 13 or place them in pin storage compartment 31.

I claim:

1. A bumper bowling game comprising:

table means having an outgoing alleyway and a return alleyway, each of the outgoing and return alleyways being elongated and having proximal and distal ends, the outgoing and return alleyways being joined at distal ends thereof such that longitudinal axes of said outgoing and return alleyways form an acute angle, each of the outgoing and return alleyways comprising a central flat surface and a concave gutter along each of left and right sides of said central flat surface;

ball starter means positioned at said proximal end of said outgoing alleyway for retaining a ball in a starting position atop said ball starter means, said ball starter means comprising a body member having a proximal end and a distal end, an upper surface of said body member defining a cup-shaped ball retainer at said proximal end of said body member and a concave starting ramp sloping downwardly from said cup-shaped ball retainer to said distal end of said body member, said body member including a vertical aperture aligned with said cup-shaped ball retainer, said ball starter means further comprising a vertical rod positioned within said vertical aperture for permitting vertical and pivotal motion of said body member with respect to said vertical rod to effect aiming and release of said ball, said ball starter means further comprising a foot member fixedly attached to a bottom end of said vertical rod, said foot member being arranged for sliding engagement within a transverse groove at the proximal end of said outgoing alleyway to thereby facilitate lateral movement of said ball ball starter means across said central flat surface of said outgoing alleyway, said ball starter means further comprising compression spring means positioned on said vertical rod for maintaining said body member in a pre-starting position in which said proximal end of said body member is slightly raised above said central flat surface of said outgoing alleyway and in which said ball is retained within said cup-shaped ball retainer, said compression means permitting said proximal end of said body member to be moved downward to a starting position in which said ball is moved upward out of said cup-shaped ball retainer by contact with the top end of said vertical rod to permit said ball to roll by gravity down said starting ramp to gain sufficient speed to enable it to roll in an outbound direction on said central flat surface of said outgoing alleyway toward the distal end thereof;

a linear bumper positioned at the joined distal ends of said outgoing and return alleyways for deflecting a ball previously released from said ball starter means to thereby cause the ball to reverse direction and to roll in a return direction on said central flat surface of said return alleyway toward the proximal end thereof; and a plurality of pins arranged in a predetermined standing configuration at a proximal end of said return alleyway so as to be contacted and knocked down by said ball rolling in said return direction on said central flat surface of said return alleyway.

* * * * *